US009806411B2

(12) United States Patent
Hwang et al.

(10) Patent No.: US 9,806,411 B2
(45) Date of Patent: Oct. 31, 2017

(54) ANTENNA WITH HIGH ISOLATION

(71) Applicant: FOXCONN INTERCONNECT TECHNOLOGY LIMITED, Grand Cayman (KY)

(72) Inventors: Tzu-Yao Hwang, New Taipei (TW); Lung-Sheng Tai, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 361 days.

(21) Appl. No.: 14/522,603

(22) Filed: Oct. 24, 2014

(65) Prior Publication Data

US 2015/0123866 A1 May 7, 2015

(30) Foreign Application Priority Data

Nov. 6, 2013 (TW) ..... 102140199 A

(51) Int. Cl.
*H01Q 1/52* (2006.01)
*H01Q 9/42* (2006.01)
*H01Q 1/48* (2006.01)

(52) U.S. Cl.
CPC ..... *H01Q 1/526* (2013.01); *H01Q 9/42* (2013.01); *H01Q 1/48* (2013.01)

(58) Field of Classification Search
CPC ..... H01Q 1/526; H01Q 9/42; H01Q 1/48
See application file for complete search history.

(56) References Cited

U.S. PATENT DOCUMENTS 8,022,882 B2 * 9/2011 Tsai ..... H01Q 5/35 343/700 MS
2005/0088351 A1 4/2005 Tai et al.
2007/0040750 A1 * 2/2007 Tai ..... H01Q 1/22 343/700 MS
2014/0125527 A1 * 5/2014 Tai ..... H01Q 1/243 343/700 MS

FOREIGN PATENT DOCUMENTS

TW 201021287 A 6/2012
TW I367599 7/2012
TW M463914 10/2013

* cited by examiner

*Primary Examiner* — Dameon E Levi
*Assistant Examiner* — David Lotter
(74) *Attorney, Agent, or Firm* — Wei Te Chung; Ming Chieh Chang

(57) ABSTRACT

An antenna includes a grounding portion extending in a longitudinal direction, a main body and an isolating portion extending from the grounding portion, a metal foil assembled on the grounding portion and a coaxial cable connecting the main body. The grounding portion includes a first section and a second section connecting with each other. The main body extends from the first section while the isolating portion extends from the second section. The isolating portion locates beside the main body in the longitudinal direction and defines a gap therebetween.

19 Claims, 4 Drawing Sheets

ANTENNA WITH HIGH ISOLATION

BACKGROUND OF THE INVENTION

1. Field of the Invention

The present disclosure relates to an antenna, and more particularly to a high isolation antenna.

2. Description of Related Art

With the development of technology, more and more portable electronic devices are equipped with wireless transceiver for transmitting wireless signals, so antenna is integrated therein. In order to meet the wireless signal transmission on different frequency band, the portable electronic equipment is often integrated with two or more antennas. However, with the miniaturization tendency of portable electronic devices, the internal space of the electronic device becomes smaller and smaller and the distance between two antennas becomes closer and closer. Thus the isolation therebetween becomes bad and can not meet the normal requirement of each antenna.

In view of the above, an improved antenna is desired to overcome the problems mentioned above.

SUMMARY OF THE INVENTION

Accordingly, an object of the present disclosure is to provide an antenna with high isolation.

According to one aspect of the present disclosure, an antenna with an isolating portion is provided. The antenna comprises a grounding portion extending in a longitudinal direction, a main body and an isolating portion extending from the grounding portion, a metal foil assembled on the grounding portion and a coaxial cable connecting the main body. The grounding portion comprises a first section and a second section connecting with each other. The main body extends from the first section while the isolating portion extends from the second section. The isolating portion locates beside the main body in the longitudinal direction and defines a gap therebetween.

Other objects, advantages and novel features of the disclosure will become more apparent from the following detailed description when taken in conjunction with the accompanying drawings, in which:

DETAILED DESCRIPTION OF THE INVENTION

Reference will now be made to the drawings to describe a preferred embodiment of the present disclosure in detail.

Figure 1:
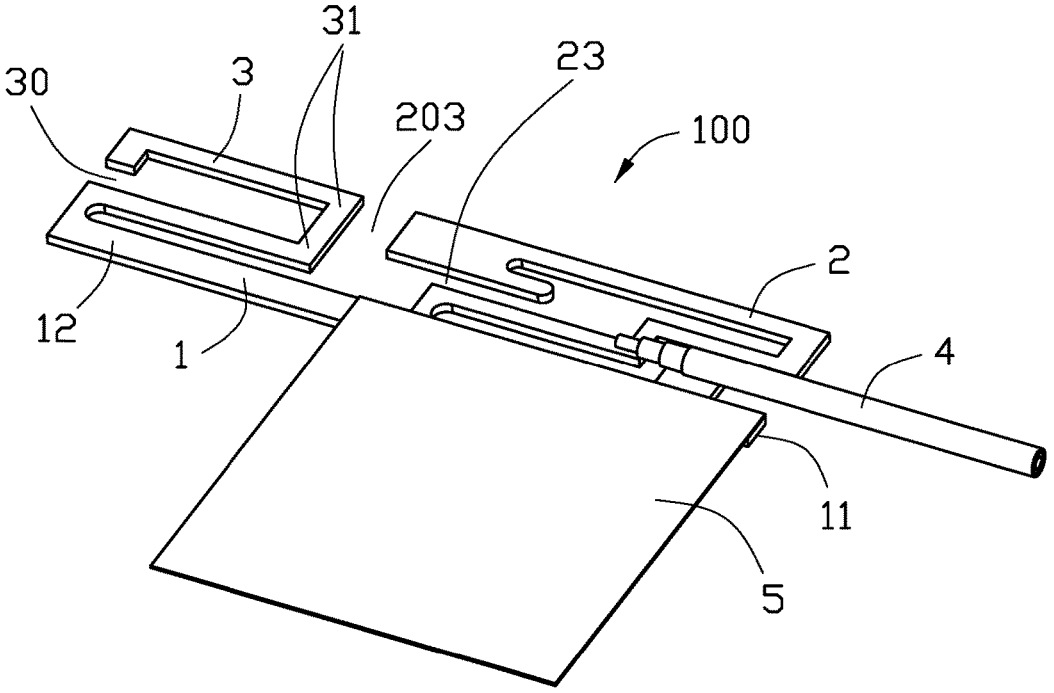
FIG. 1 is an assembled, perspective view of an antenna in accordance with a preferred embodiment of the present disclosure.

Referring to FIG. 1, an antenna 100 is stamped from a metal plate. The antenna 100 extends in a longitudinal direction/X-axis (see in FIG. 2), comprising a grounding portion 1 integrally extending in the longitudinal direction and defining two opposite ends (10*a*, 10*b*), a main body 2 and an isolating portion 3 integrally extending from the grounding portion 1 in a vertical direction/Y-axis (see in FIG. 2) perpendicular to the longitudinal direction, a coaxial 4 connecting the main body 2 and a metal foil 5 assembled on the grounding portion 1.

Figure 2:
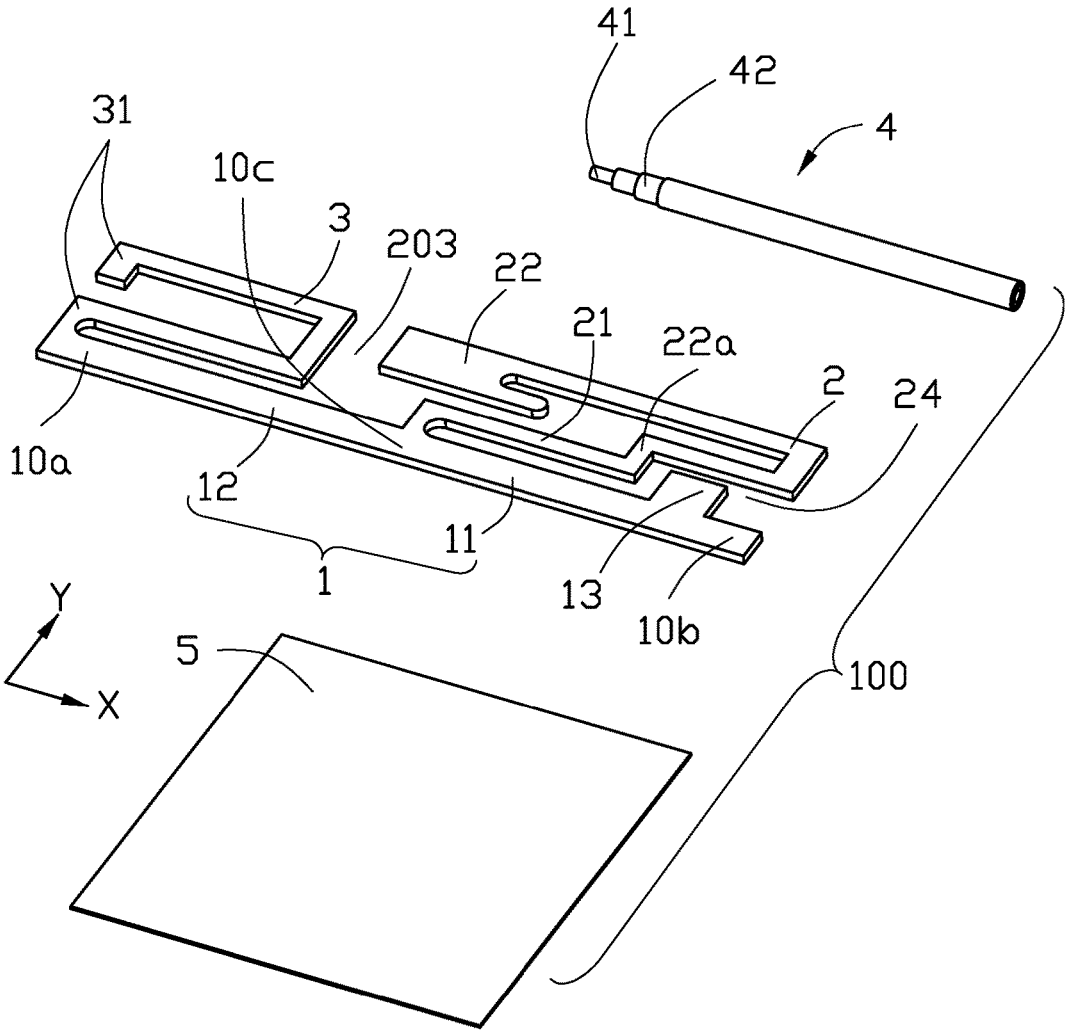
FIG. 2 is an exploded, perspective view of the antenna shown in FIG. 1.

Referring to FIG. 2, the grounding portion 1 comprises a first section 11 and a second section 12 in the longitudinal direction. The main body 2 directly and integrally extends upwardly in the vertical direction from an upper edge of the first section 11 at a middle area 10*c* of the grounding portion 1 between said two opposite ends (10*a*, 10*b*). The main body 2 defines a continuous step structure which comprises an L-shaped/step structured connecting portion 21 and a radiating portion 22 integrally extending from the connecting portion 21. The radiating portion 22 firstly extends upwardly in the vertical direction to form a vertical section 22*a*, then extends in the longitudinal direction, and then extends in the vertical direction again, at last extending backwardly in the longitudinal direction. The connecting portion 21 and the radiating portion 22 define an opening 23 facing towards the isolating portion 3. The continuous step structure of the main body 2 cooperates with and extends away from the grounding portion 1 to define an L-shaped slot 24 therebetween. The antenna 100 further comprises a tab 13 extending upwardly from the first section 11 and into the L-shaped slot 24. The coaxial cable 4 comprises an inner conductor 41 soldering on the joint of the connecting portion 21 and the vertical section 22*a* of the radiating portion 22, and an outer conductor 42 surrounding the inner conductor 41 for soldering on the tab 13. The antenna 100 works at the frequency bands of 2.4-2.5 GHz and 5.15-5.85 GHz.

The isolating portion 3 directly and integrally extends from an upper edge of the second section 12. The isolating portion 3 defines a plurality of bends 31 and is substantially a rectangular frame with a cutout 30 (see in FIG. 1) facing opposite to the main body 2 in the longitudinal direction. The isolating portion 3 is coplanar with the main body 2 and defines a gap 203 cooperating with the main body 2. That is, the isolating portion 3 is located beside and spaced from the main body 2 in the longitudinal direction. The metal foil 5 connects the first section 11 of the grounding portion 1. The dimension of the metal foil 5 in the longitudinal direction is less than that of the grounding portion 1, i.e. at least partial of the grounding portion 1 is not covered by the metal foil 5 in the longitudinal direction. The frequency of the antenna 100 can be adjusted by changing the dimension of the metal foil 5 so that the antenna can be manufactured with a rough tolerance. In this embodiment, the metal foil 5 does not across the gap 203 in the longitudinal direction.

Figure 3:
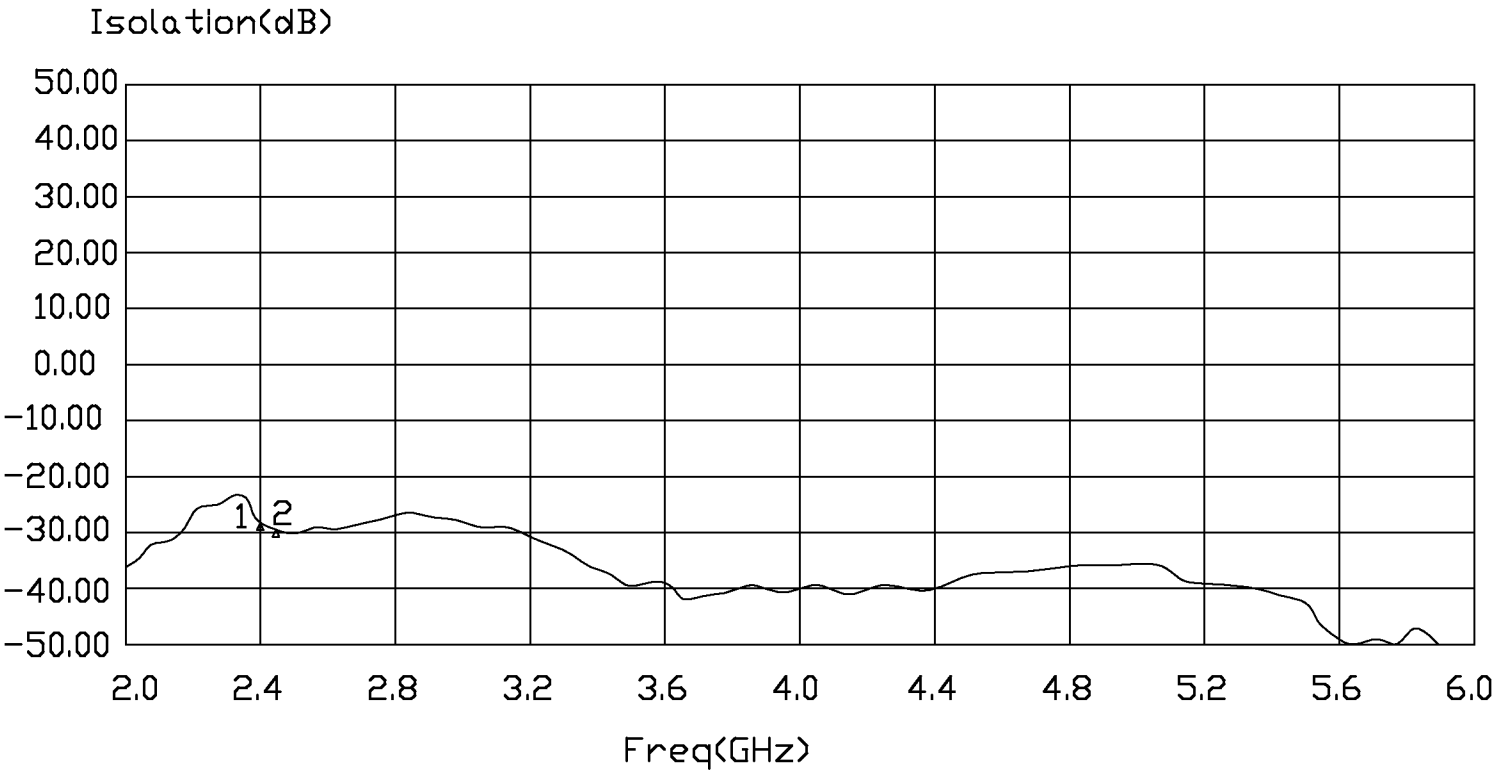
FIG. 3 is an isolation chart of the antenna shown in FIG. 1.
Figure 4:
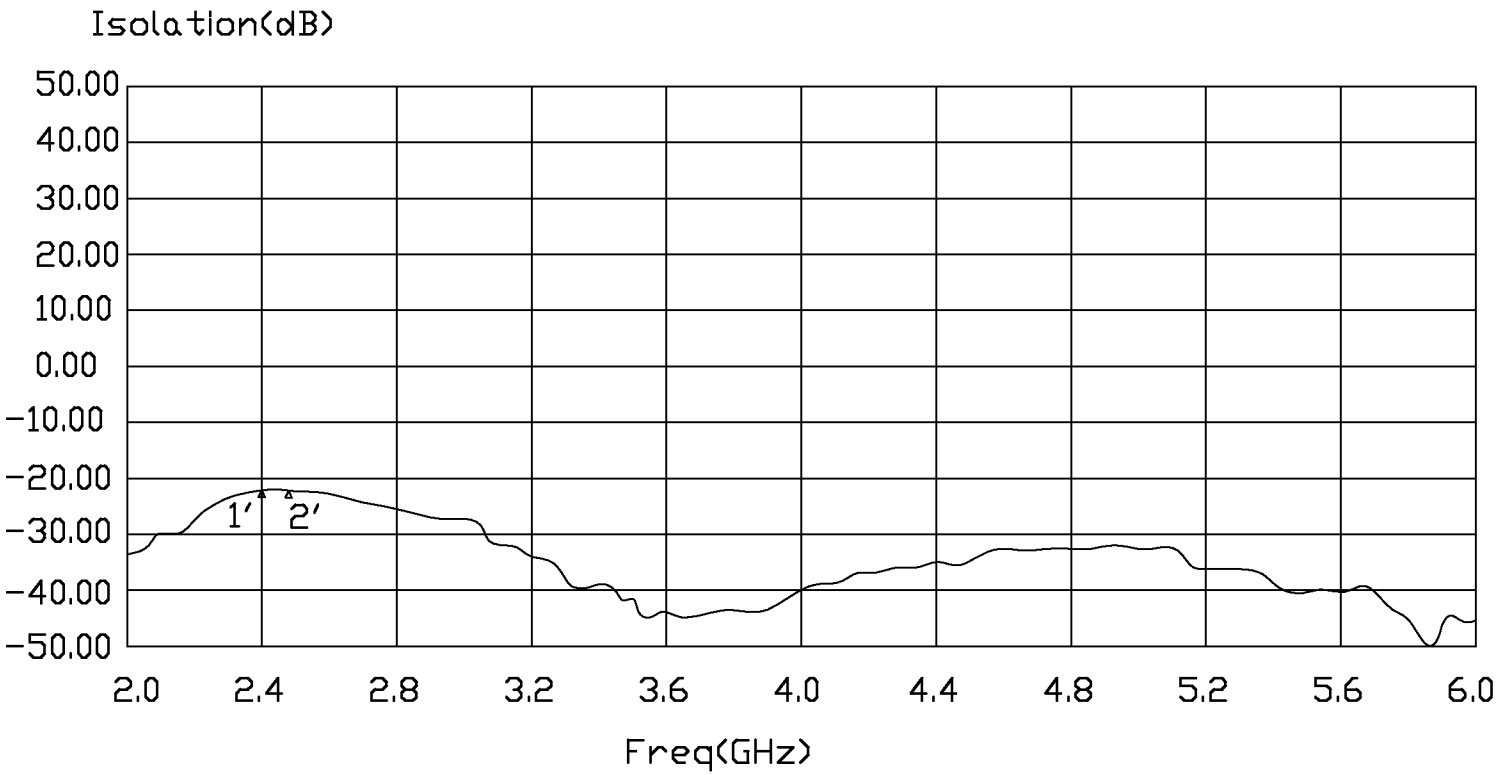
FIG. 4 is an isolation chart of an antenna without an isolating portion.

FIG. 3 shows the isolation chart of the present antenna 100. On the frequency band of 2.4-2.5 GHz, the isolation is less than −25 dB. Referring to point numbered 1, wherein the frequency is 2.4 GHz, the isolation is −28.9 dB; referring to point numbered 2, wherein the frequency is 2.5 GHz, the isolation is −29.5 dB. The antenna 100 of the present disclosure performs a high isolation. FIG. 4 is a comparison chart without the isolating portion. As the points numbered as 1' and 2' show, when the frequency band is 2.4-2.5 GHz, the isolation is about −23 dB, the isolation is bad.

While preferred embodiment in accordance with the present disclosure has been shown and described, equivalent modifications and changes known to persons skilled in the art according to the spirit of the present disclosure are considered within the scope of the present disclosure as defined in the appended claims.

What is claimed is:

1. An antenna comprising:

a grounding portion extending in a longitudinal direction, comprising a first section and a second section connecting with each other;

a main body directly and integrally extending from the first section in a vertical direction perpendicular to the longitudinal direction;

an isolating portion directly and integrally extending from the second section of the grounding portion, the isolating portion located beside and spaced from the main body with a gap therebetween in the longitudinal direction;

a metal foil assembled on the first section of the grounding portion; and a coaxial cable connecting the main body.

2. The antenna as claimed in claim 1, wherein the dimension of the metal foil in the longitudinal direction is less than that of the grounding portion.

3. The antenna as claimed in claim 1, wherein the isolating portion is coplanar with the main body.

4. The antenna as claimed in claim 3, wherein the metal foil does not exceed the gap in the longitudinal direction.

5. The antenna as claimed in claim 1, wherein the main body comprises a connecting portion connecting to a middle area of the grounding portion and extending toward one end of the grounding portion; and a radiating portion extending from one end of the connecting portion and extending toward the other end of the grounding portion, and wherein both the connecting portion and the radiating portion comprise parts extending in the longitudinal direction and defining an opening facing towards the isolating portion.

6. The antenna as claimed in claim 5, wherein the isolating portion connects to the other end of the grounding portion and defines a substantially rectangular frame extending toward said main portion, said rectangular frame defines a cutout at one side edge opposite to the main body.

7. The antenna as claimed in claim 1, wherein the antenna further comprises a tab extending upwardly from the first section, the coaxial cable comprises an outer conductor soldering on the tab.

8. The antenna as claimed in claim 1, wherein the frequency bands of the antenna are 2.4-2.5 GHz and 5.15-5.85 GHz.

9. An antenna comprising:

a grounding portion integrally extending in a longitudinal direction and defining two opposite ends;

a main body directly and integrally extending from a middle area of the grounding portion between said two opposite ends, the main body located adjacent to one of said two opposite ends;

an isolating portion directly and integrally extending from the other end and defining a gap with the main body;

a metal foil assembled on the grounding portion and adjacent to said one end; and a coaxial cable comprising an inner conductor connecting the main body and an outer conductor connecting the grounding portion and closing to said one end; wherein the insolating portion is located beside and spaced from the main body in the longitudinal direction.

10. The antenna as claimed in claim 9, wherein the metal foil does not exceed the gap in the longitudinal direction.

11. The antenna as claimed in claim 9, wherein the antenna comprises a tab extending from the grounding portion and closing to said one end, the outer conductor is soldered on the tab.

12. The antenna as claimed in claim 9, wherein the isolating portion is substantially a rectangular frame with a cutout facing opposite to the main body.

13. An antenna comprising:

a grounding portion integrally extending along a longitudinal direction;

a main body directly and integrally extending upwardly from a middle area of the grounding portion in said longitudinal direction, said main body including a step structured connecting portion linked to the grounding portion and an L-shaped section of a radiating portion above the connecting portion;

a tab extending upwardly around one longitudinal end of grounding portion and below the main body;

a feeding cable including an outer conductor mechanically and electrically connected to the tab, and an inner conductor mechanically and electrically connected to the connecting portion; and an isolating portion directly and integrally extending from the other longitudinal end of the grounding portion with a plurality of bends extending initially toward the main body and finally ending around said other longitudinal end in said longitudinal direction; wherein a gap is formed between the radiating portion and the isolating portion in the longitudinal direction; wherein the isolating portion is located beside and spaced from the main body in the longitudinal direction.

14. The antenna as claimed in claim 13, wherein a metallic foil is attached to the grounding portion under the main body.

15. The antenna as claimed in claim 14, wherein one end of the metallic foil along said longitudinal direction, is terminated not to extend beyond the radiation portion in said longitudinal direction.

16. The antenna as claimed in claim 13, wherein said main body cooperates with the grounding portion to define a slot therebetween, and the tab is located in said slot.

17. The antenna as claimed in claim 16, wherein the main body defines a continuous step structure to form said slot.

18. The antenna as claimed in claim 17, wherein said continuous step structure defines a vertical section, and the inner conductor is attached to said vertical section.

19. The antenna as claimed in claim 13, wherein the radiating portion is closer, in said longitudinal direction, to the isolating portion than the connecting portion is.

* * * * *